US006949724B2

(12) United States Patent
Kagawa et al.

(10) Patent No.: US 6,949,724 B2
(45) Date of Patent: Sep. 27, 2005

(54) HEATING DEVICE AND HEATING METHOD

(75) Inventors: Toshiaki Kagawa, Kitakatsuragi-gun (JP); Shogo Yokota, Fujiidera (JP)

(73) Assignee: Sharp Kabushiki Kaisha, Osaka (JP)

( * ) Notice: Subject to any disclaimer, the term of this patent is extended or adjusted under 35 U.S.C. 154(b) by 1 day.

(21) Appl. No.: 10/984,317

(22) Filed: Nov. 8, 2004

(65) Prior Publication Data

US 2005/0061792 A1 Mar. 24, 2005

Related U.S. Application Data

(62) Division of application No. 10/455,702, filed on Jun. 4, 2003, now Pat. No. 6,835,918.

(30) Foreign Application Priority Data

Jun. 13, 2002 (JP) ..... P2002-173312

(51) Int. Cl.[7] ..... H05B 27/06; H05B 3/02

(52) U.S. Cl. ..... 219/469; 219/216; 29/592.1; 29/611

(58) Field of Search ..... 219/216, 469, 219/388; 399/69, 333, 335, 70, 329; 29/611, 592.1, 593, 602.1, 825, 603.01, 603.07

(56) References Cited

U.S. PATENT DOCUMENTS 4,719,489 A 1/1988 Ohkubo et al.
4,973,824 A 11/1990 Ohashi et al.
5,329,343 A 7/1994 Saito
5,349,905 A 9/1994 Taylor et al.
5,512,993 A 4/1996 Endo et al.
5,729,884 A * 3/1998 Stephany et al. ..... 29/592.1
5,839,043 A 11/1998 Okabayashi et al.
5,847,361 A 12/1998 Yonekawa et al.
6,008,829 A 12/1999 Wakamiya et al.
6,088,549 A 7/2000 Kagawa et al.
6,333,490 B1 12/2001 Higashi et al.
6,438,348 B2 8/2002 Kobaru et al.
6,580,883 B2 6/2003 Suzumi
6,643,478 B2 11/2003 Okano
6,691,399 B1 * 2/2004 Hayashi et al. ..... 29/605
6,835,918 B2 * 12/2004 Kagawa et al. ..... 219/469

FOREIGN PATENT DOCUMENTS

JP 01-052184 A 2/1989
JP 10-133505 5/1998

* cited by examiner

*Primary Examiner*—Robin O. Evans
*Assistant Examiner*—Leonid M Fastovsky
(74) *Attorney, Agent, or Firm*—Edwards & Angell LLP; David G. Conlin; David A. Tucker

(57) ABSTRACT

An upper heat roller with an external heat source and a lower heat roller with an internal heat source are arranged with a paper transport path therebetween, in such a manner as to be pressed against each other. The lower heat roller is heated sufficiently, thereby supplying a paper sheet with sufficient heat when the paper sheet is transported through a contact region between the upper and lower heat rollers to be heated.

3 Claims, 10 Drawing Sheets

FIG. 1

| | HEAT TRANSFER EFFICIENCY (A) | POWER SUPPLY LIMIT (B) | TRANSFERRED HEAT ENERGY TO HEAT ROLLER (A x B) |
|---|---|---|---|
| INTERNAL HEATING TYPE | 70% | 1200W | 840W |
| EXTERNAL HEATING TYPE | 45% | 510W (HEAT SUPPLY ROLLER TEMPERATURE: 200°C) | 232W |

PRIOR ART

FIG. 5

| OPERATION MODE | SET TEMPERATURE (°C) | | | DRIVE MOTOR |
|---|---|---|---|---|
| | HEAT SUPPLY ROLLER | UPPER HEAT ROLLER | LOWER HEAT ROLLER | |
| WARM-UP | 190 | (130) | 150 | ON |
| COPY | (190) | 130 | 150 | ON |
| STANDBY | 150 | — | 150 | OFF |
| ENERGY-SAVING (SLEEP) | — | — | — | OFF |

FIG. 6

| | POWER DISTRIBUTION (W) | | TIME REQUIRED TO REACH SET TEMPERATURE (Sec) | | | POWER CONSUMP-TION (Wh) | WARM-UP TIME (Sec) |
|---|---|---|---|---|---|---|---|
| | HEATER FOR HEAT SUPPLY ROLLER | HEATER FOR LOWER HEAT ROLLER | HEAT SUPPLY ROLLER | UPPER HEAT ROLLER | LOWER HEAT ROLLER | | |
| COMPARATIVE EXAMPLE 1 | 450 | 700 | 35 | 28 | 28 | 9.9 | 35 |
| COMPARATIVE EXAMPLE 2 | 750 | 400 | 20 | 32 | 38 | 10.8 | 38 |
| PRESENT EMBODIMENT | 550 | 600 | 29 | 28 | 30 | 9.6 | 30 |

FIG. 7

| No | UPPER HEAT ROLLER TEMPERA-TURE (°C) | LOWER HEAT ROLLER TEMPERA-TURE (°C) | WARM-UP TIME (Sec) | TRANSFERRED HEAT QUANTITY TO PAPER (J/Sheet) | | | CREASE PERFORMANCE | |
|---|---|---|---|---|---|---|---|---|
| | | | | Q1 | Q2 | (Q2-Q1)/(Q2+Q1) | 64 g/ m² PAPER | 128 g/ m² PAPER |
| ① | 120 | 170 | 32 | 64 | 501 | 0.77 | ◎ | × |
| ② | 125 | 160 | 31 | 113 | 434 | 0.59 | ◎ | △ |
| ③ | 130 | 150 | 30 | 166 | 366 | 0.38 | ◎ | ○ |
| ④ | 135 | 140 | 31 | 219 | 299 | 0.15 | ◎ | ○ |
| ⑤ | 140 | 130 | 41 | 276 | 230 | −0.08 | ◎ | ◎ |

FIG. 8

| No | W (g/m²) | L (mm) | V(mm/s) | (W/Wr) * (L/Lr) * (V/Vr) | CREASE PERFORMANCE | HIGH-TEMPERATURE OFFSET |
|---|---|---|---|---|---|---|
| ① | 280 | 210 | 117 | 4.38 | × | ○ |
| ② | 180 | 210 | 117 | 2.81 | × | ○ |
| ③ | 128 | 210 | 117 | 2.00 | △ | ○ |
| ④ | 105 | 210 | 117 | 1.64 | △ | ○ |
| ⑤ | 64 | 297 | 117 | 1.41 | △ | ○ |
| ⑥ | 75 | 210 | 117 | 1.17 | ◎ | ◎ |
| ⑦ | 64 | 210 | 117 | 1.00 | ◎ | ◎ |
| ⑧ | 128 | 210 | 56.5 | 0.97 | ◎ | ◎ |
| ⑨ | 180 | 210 | 39 | 0.94 | ◎ | ◎ |
| ⑩ | 280 | 210 | 24 | 0.90 | ◎ | ◎ |
| ⑪ | 105 | 210 | 56.5 | 0.79 | ◎ | ◎ |
| ⑫ | 64 | 297 | 56.5 | 0.68 | ◎ | ◎ |
| ⑬ | 75 | 210 | 56.5 | 0.57 | ◎ | × |
| ⑭ | 64 | 210 | 56.5 | 0.48 | ◎ | × |

FIG. 9

| | UPPER HEAT ROLLER TEMPERATURE (°C) | LOWER HEAT ROLLER TEMPERATURE (°C) | CREASE PERFORMANCE ON SECOND SURFACE | HIGH-TEMPERATURE OFFSET ON FIRST SURFACE |
|---|---|---|---|---|
| COMPARATIVE EXAMPLE | 130 | 150 | ◎ | × |
| PRESENT EMBODIMENT | 130 | 130 | ○ | ○ |

FIG. 10

| | SET TEMPERATURE (°C) | | | DRIVE MOTOR | POWER CONSUMPTION (W) | RECOVERY TIME (Sec) | ROLLER LIFE |
|---|---|---|---|---|---|---|---|
| | HEAT SUPPLY ROLLER | UPPER HEAT ROLLER | LOWER HEAT ROLLER | | | | |
| COMPARATIVE EXAMPLE 1 | (120) | 130 | 150 | ON | 147 | 0 | × |
| COMPARATIVE EXAMPLE 2 | 190 | — | 150 | OFF | 111 | 5 | △ |
| PRESENT EMBODIMENT | 150 | — | 150 | OFF | 72 | 6.6 | ○ |

HEATING DEVICE AND HEATING METHOD

This is a divisional patent application of U.S. patent application Ser. No. 10/455,702 filed Jun. 4, 2003 now U.S. Pat No. 6,835,918, by Toshiaki Kagawa and Shogo Yokota (the same inventors as of this divisional application), entitled "Heating Device and Heating Method" (now allowed).

BACKGROUND OF THE INVENTION

1. Technical Field of the Invention

The present invention relates to a heating device and a heating method applicable to: a fixing device provided in a dry electrophotographic apparatus; a drying device provided in a wet electrophotographic apparatus; a drying device provided in an inkjet image forming apparatus; an erasing device for rewritable media, etc.

2. Description of Related Art

While there are several types of heating devices applicable to a fixing device provided in an electro-photographic image forming apparatus, a drying device provided in an inkjet image forming apparatus, and the like, an image forming apparatus of internal heating type is widely in use. Generally, the image forming apparatus of internal heating type is provided with a heat supplier as a heat source such as a halogen heater, inside a heating member such as a heat roller composed of a hollow metal core made of aluminum or the like. The surface of the heating member is heated by the heat supplier to be set at a predetermined temperature, thereby heating a heated member such as a paper sheet.

However, the image forming apparatus of internal heating type has had the following drawbacks. In the image forming apparatus of internal heating type, it takes a long time before the surface of the heating member reaches a predetermined set temperature after the heating member starts to be heated. Namely, what is called warm-up time is long. Accordingly the heating member needs to be maintained at a certain temperature even during a standby period, for example for quick recovery from a standby state to a normal operation state. Consequently, the heating device has high standby power consumption.

As a heating device which enables a shorter warm-up time and lower standby power consumption, the Japanese Publication for Laid-Open Patent Application No. 10-133505 has disclosed a heating device of external heating type wherein the surface of a heating member is heated by a heat supply roller arranged in the vicinity of the heating member in such a manner as to be in contact with the surface of the heating member.

Since the surface of the heating member is in contact with a heat source to supply heat thereto, the heating device of external heating type has high thermal efficiency, thereby allowing a warm-up time to be reduced greatly.

Compared with the heating device of internal heating type, however, a conventional heating device of external heating type has had the two following drawbacks, which is the case with the one as disclosed in the Japanese Publication for Laid-Open patent Application No. 10-133505.

First, the heating device of external heating type has low heat-supply performance in heat supply to the heating member.

FIG. 1 illustrates results of calculating from a two-dimensional heat transfer analysis a ratio of heat energy used to heat a heat roller as a heating member to electrical energy supplied to a halogen heater as a heat source, in respective heating devices of internal and external heating types. The main conditions of the above calculation are: diameter of heat roller: 40 mm, both in internal and external heating types; diameter of heat supply roller as a first heat supplier: 15 mm; temperature of heat supply roller: 200° C.; rated apparent power: 1200 W.

In the heating device of external heating type, since the heat supply roller as the heat supplier is arranged outside the heat roller, heat energy is lost by the amount of heat escaping from the heat supply roller into the atmosphere. Therefore, heat transfer efficiency in heat transfer from the heat source to the heat roller is lower than in the heating device of internal heating type.

Further, in the heating device of external heating type, there is a limit to a surface temperature of the heat supply roller depending on heat-resistant temperatures of a material thereof and a material used for the surface of the heat roller. If a fluorocarbon resin material is in use for the surface of the heat roller, for example, the allowable maximum temperature of the surface of the heat supply roller is approximately 200° C. Consequently, electric power supplied to the heat supply roller for supplying heat to the heat roller is also limited, with the result that transferred heat energy to the heat roller becomes approximately one-quarter as high as transferred heat energy in the heating device of internal heating type.

Second, the heating device of external heating type has high standby power consumption. More specifically, while enabling much shorter warm-up time compared to the heating device of internal heating type, the heating device of external heating type requires warm-up time of approximately 30 seconds, and thus still needs to be preheated during a standby period.

For preheating the heat roller during the standby period, accordingly, the heat supply roller and the heat roller must be driven to rotate with both of the rollers pressed against each other. This leads not only to higher standby power consumption by a drive system or the like of each of the rollers, but also to shorter life of the heat roller.

SUMMARY OF THE INVENTION

It is an object of the present invention to provide a heating device and a heating method enabling a shorter warm-up time, lower standby power consumption, and high-efficiency heat supply to heating members.

According to the present invention, first and second heating members are arranged with a paper transport path therebetween in such a manner as to be pressed against each other, the paper transport path being for transporting thereon a paper sheet to be heated. When the paper sheet is transported between the first and second heating members, even if there may be a decrease in an amount of heat supplied from the first heating member to the paper sheet, a required amount of heat is supplied to the paper sheet by increasing an amount of heat supplied to the paper sheet from the second heating member supplied with a sufficient amount of heat.

For example, in a case in which an external heating method is applied in the first heating member, when there is a decrease in an amount of heat supplied from the first heating member to a paper sheet, an amount of heat supplied from the second heating member to the paper sheet is increased by heating the second heating member sufficiently by an internal heating method such that the temperature of the second heating member is higher than the temperature of the first heating member. Further, the temperatures of the surfaces of the first and second heating members are controlled by a control device in such a manner as to be optimal temperatures in terms of power consumption and crease performance.

BRIEF DESCRIPTION OF THE DRAWINGS

FIG. 1 is a table illustrating heat transfer efficiency in heat transfer to heating members provided in respective heating devices of internal and external heating types;

FIG. 5 is a table of set temperatures and on/off states of a drive motor in respective operation modes;

FIG. 6 is a table illustrating relationships between power distribution to respective halogen heaters and power consumption, etc.;

FIG. 7 is a table illustrating relationships between transferred heat quantities Q1 and Q2, and crease performance, etc;

FIG. 8 is a table illustrating the results of experiments on relationships between (a) basis weight, length in the paper transport direction, and fixing speed of a paper sheet, and (b) crease performance and occurrence of offset thereon;

FIG. 9 is a table illustrating the result of an experiment conducted to evaluate crease performance on a second surface of a paper sheet and high-temperature offset on a first surface of the same in duplex printing; and FIG. 10 is a table illustrating the result of an experiment on average power consumption, recovery time to copy mode, and life of respective rollers, in cases where the temperatures of the respective rollers are set differently in standby mode.

DESCRIPTION OF THE PREFERRED EMBODIMENTS

The following is a description with reference to FIGS. 1 through 10 of an embodiment of the present invention in which a heating device and a heating method of the present invention are applied to a fixing device provided in an electrophotographic image forming apparatus. Although the following embodiment describes a multi-color image forming apparatus, the present invention is suitable for use in an image forming apparatus comprising a single image forming station.

Figure 2:
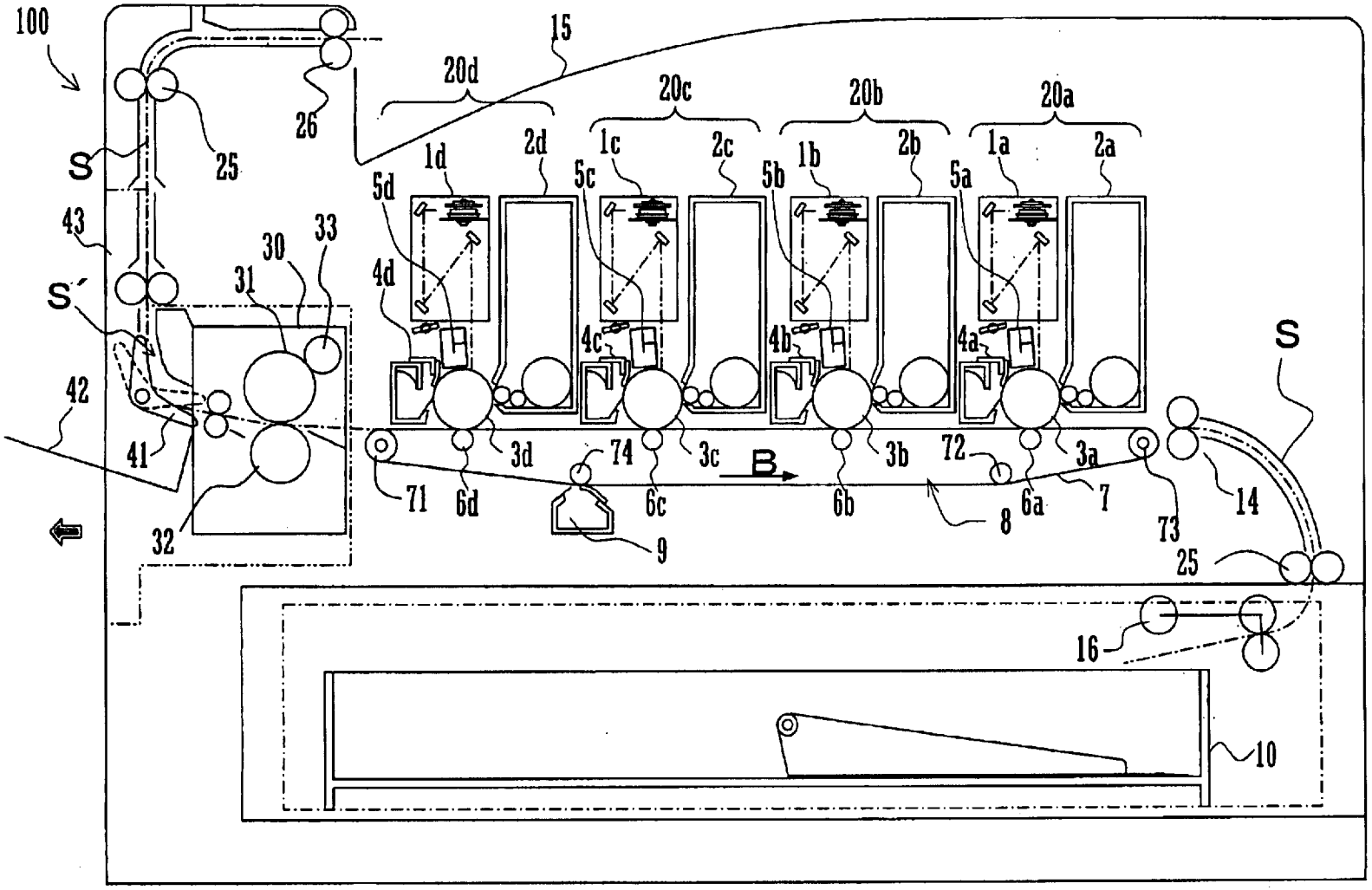
FIG. 2 is a configuration diagram of an image forming apparatus with a heating device of the present invention applied thereto.

FIG. 2 illustrates configuration of an image forming apparatus 100 utilizing an electrophotographic process in which the heating device and heating method of the present invention are applied. The image forming apparatus 100 forms multi-color and monochromatic images on a paper sheet (including a sheet material such as a transfer or recording material) in accordance with image data supplied externally, as illustrated in FIG. 2.

The image forming apparatus 100 is provided with a paper transport path S leading from a paper feed tray 10 with paper sheets stored therein to a paper eject roller 26 for ejecting a paper sheet, as illustrated in FIG. 2. The paper transport path S is provided in the center of the image forming apparatus 100. Arranged vis-à-vis with the paper transport path S therebetween are four image forming stations 20 (20*a* to 20*d*) for performing image forming operation with respect to the respective color elements black (K), cyan (C), magenta (M), and yellow (Y), and a transfer/transport belt unit 8 for holding and conveying a paper sheet onto which the image forming operation is to be performed, downstream in the paper transport path S. Besides, a fixing device 30 as the heating device of the present invention is located at a downstream part with respect to the image forming stations 20 in the paper transport path S.

In each of the image forming stations 20 (20*a* to 20*d*) a photosensitive drum 3 (3*a* to 3*d*) as an image carrier is arranged in such a manner as to be in contact with the paper transport path S. Provided around the photosensitive drum 3 are an exposure unit 1 (1*a* to 1*d*), a developing device 2 (2*a* to 2*d*), a charging device 5, and a cleaning unit 4 (4*a* to 4*d*).

The charging device 5 is a means for applying an electrostatic charge uniformly over the surface of the photosensitive drum 3. The charging device 5 that is in use in the present embodiment is of a charger type as illustrated in FIG. 2. Alternatively, a charging device of contact type in roller or brush form may be used as the charging device 5. The exposure unit 1 is in use for forming an electrostatic latent image by exposing the surface of the photosensitive drum 3 in accordance with provided image data. Used as the exposure unit 1 is a laser scanning unit (LSU) which is provided with a laser radiation portion and reflecting mirrors. Alternatively, a writing head provided with an array of light emitting elements, such as an EL or LED array, may be used as the exposure unit 1.

The developing device 2 develops an electrostatic latent image formed on the photosensitive drum 3 into a visible image with toner of each of the color elements black (K), cyan (C), magenta (M), and yellow (Y). The cleaning unit 4 removes and captures toner residue on the surface of the photosensitive drum 3 after transfer process.

The transfer/transport belt unit 8 is arranged vis-à-vis the photosensitive drums 3 of the respective image forming stations 20 (20*a* to 20*d*) with the paper transport path S therebetween. The transfer/transport belt unit 8 is provided with a transfer belt 7, a transfer belt drive roller 71, a transfer belt tension roller 72, a transfer belt driven roller 73, a transfer belt support roller 74, transfer rollers 6 (6*a* to 6*d*), and a transfer belt cleaning unit 9.

Under normal operation, the transfer belt drive roller 71, the transfer belt tension roller 72, the transfer rollers 6, the transfer belt driven roller 73, and the transfer belt support roller 74 are driven to rotate counterclockwise in FIG. 2, causing the transfer belt 7 installed over the rollers to rotate in the direction of arrow B. The transfer rollers 6, rotatably mounted on an inner frame (not shown) of the transfer/transport belt unit 8, transfer toner images formed on the photosensitive drums 3 onto a paper sheet on the transfer belt 7.

The transfer belt 7 is arranged in such a manner as to be in contact with the photosensitive drums 3 of the respective image forming stations 20 (20*a* to 20*d*). The transfer belt 7 is made in endless form using a film with a thickness of about 100 $\mu$m.

The transfer rollers 6 arranged to abut on the reverse side of the transfer belt 7 perform transfer of toner images from the photosensitive drums 3 onto a paper sheet. To the transfer rollers 6 high voltage is applied for the transfer of toner images. In the present embodiment, since toner is negatively charged, the high voltage to be applied is positive, opposite to the charge of the toner. Each of the transfer rollers 6 has at the center thereof a metal (e.g.

stainless steel) core with a diameter of 8 to 10 mm, the surface of the core being coated with a conductive elastic material such as EPDM or foam urethane. The conductive elastic material allows the high voltage to be applied uniformly to the paper sheet. While in the present embodiment the transfer rollers 6 are in use as transfer electrodes, a transfer brush or the like may be used as an alternate.

Toner which adheres to the transfer belt 7 by contact with the photosensitive drums 3 may contaminate the reverse side of a paper sheet, and is thus removed and captured by the transfer belt cleaning unit 9. The transfer belt cleaning unit 9 is provided with a cleaning blade which is arranged in contact with the transfer belt 7. The transfer belt support roller 74 is placed opposite the cleaning blade with the transfer belt 7 therebetween.

The paper feed tray 10, which is a tray for storing paper sheets to which image forming operation is to be performed, is provided below an image forming section of the image forming apparatus 100. A paper eject tray 15 provided on top of the image forming apparatus 100 is a tray for placing a printed paper sheet face down. Additionally, a paper eject tray 42 provided on a side surface of the image forming apparatus 100 is a tray for placing face up a paper sheet with images formed thereon.

Along the paper transport path S formed in the shape of the letter S as shown in FIG. 2, a pick-up roller 16, registration rollers 14, the fixing device 30, and a transport direction switching gate 41 are arranged in order of flow of paper transport. Also, a plurality of transport rollers 25 for transporting a paper sheet are arranged at certain points all along the paper transport path S.

The transport rollers 25 are small rollers provided at several points along the paper transport path S for facilitating and assisting transport of a paper sheet. The pick-up roller 16 is provided at an end part of the paper feed tray 10 for picking up only a paper sheet which is situated on the top of paper sheets stored in the paper feed tray 10, and feeding the paper transport path S with the paper sheet.

The transport direction switching gate 41, which is rotatably mounted on a side cover 43 of the image forming apparatus 100, is moved as necessary between states illustrated by solid and dashed lines respectively. When the transport direction switching gate 41 is in the state as illustrated by the dashed line in FIG. 2, a paper sheet is made to diverge from the paper transport path S to be ejected into the paper eject tray 42. When the transport direction switching gate 41 is in the state as illustrated by the solid line in FIG. 2, a paper sheet is transported through a paper transport section S' which is formed by being surrounded by the fixing device 30, the side cover 43, and the transport direction switching gate 41, such that the paper sheet is ejected into the paper eject tray 15 located on top of the image forming apparatus 100.

The registration rollers 14 have functions of temporarily holding a paper sheet which is being transported on the paper transport path S, in order to adjust timing of paper transport on the paper transport path S, and transporting the paper sheet timely in accord with the rotation of the photosensitive drums 3 such that toner images on the photosensitive drums 3 can be transferred appropriately in multilayer on the paper sheet.

Figure 3:
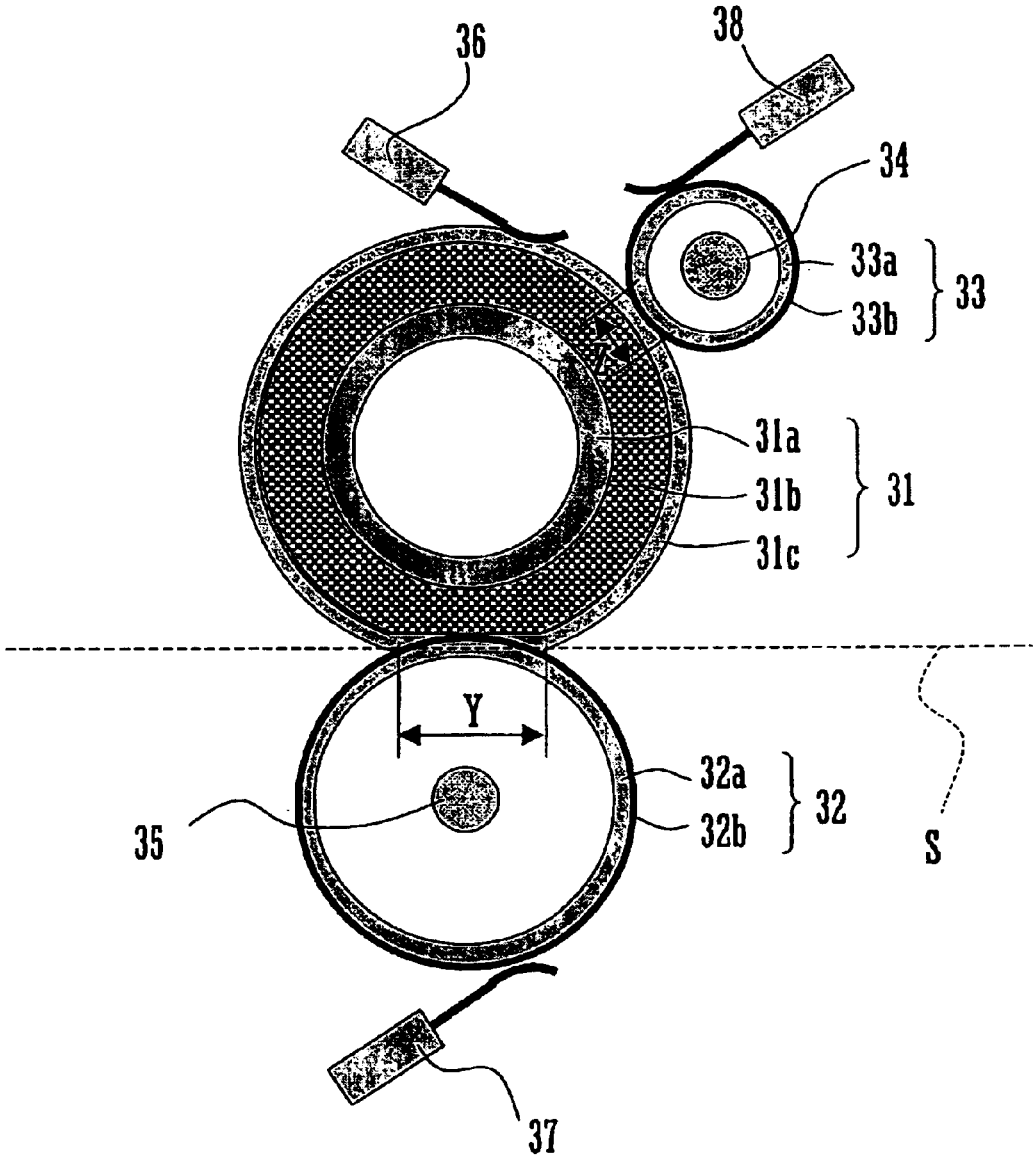
FIG. 3 is a configuration diagram of a fixing device according to an embodiment of the present invention.

FIG. 3 illustrates configuration of the fixing device 30 as the heating device of the present invention. As illustrated in the figure, the fixing device 30 is provided with: an upper heat roller 31 as a first heating member; a lower heat roller 32 as a second heating member; a heat supply roller 33 as a first heat supplier; halogen heaters 34 and 35 to serve as heat sources which supply heat to the heat supply roller 33 and the lower heat roller 32 respectively; temperature detectors 36 to 38 as detecting devices for detecting the temperatures of the upper heat roller 31, the lower heat roller 32, and the heat supply roller 33 respectively; and a control device as described later.

The upper heat roller 31 is formed to have a diameter of 40 mm. In the upper heat roller 31 a heat insulating layer 31*b* made of a heat-resistant elastic material is formed on a core 31*a*, the heat insulating layer 31*b* being coated with a coating layer 31*c* made of a heat-resistant releasing material, as illustrated in FIG. 3. In the present embodiment, the upper heat roller 31 does not have a heat source provided therein.

As the core 31*a*, a cylinder or hollow cylinder of aluminum, stainless steel or the like is used to ensure strength of the upper heat roller 31. In the present embodiment, a hollow cylindrical shaft made of aluminum with a diameter of 28 mm and a thickness of 3 mm is used as the core 31*a*.

The heat insulating layer 31*b* prevents heat of the coating layer 31*c* which is heated by the heat supply roller 33 and the lower heat roller 32 from escaping into the interior of the upper heat roller 31. A heat-resistant elastic material is used for the heat insulating layer 31*b*. For instance, a rubber material such as fluorine or silicone rubber is suitable for the heat insulating layer 31*b*. Since a foam material is preferable particularly in terms of heat insulating property, foam silicone rubber is in use in the present embodiment.

The coating layer 31*c* is formed for properly fixing toner images on a paper sheet and for preventing the surface of the upper heat roller 31 from being soiled by toner adhesion. The coating layer 31*c* receives heat from the heat supply roller 33 in a heating nip region Z and, when a paper sheet is not transported, from the lower heat roller 32 in a fixing nip region Y. When a paper sheet is transported, the coating layer 31*c* supplies the heat to the paper sheet and a toner image formed thereon in the fixing nip region Y.

Fluorocarbon resin such as PFA or PTFE is suitable for use as a heat-resistant releasing material to make up the coating layer 31*c*. In the present embodiment, a PFA tube with a thickness of 50 $\mu$m is used as the coating layer 31*c*.

The coating layer 31*c* is also intended for reducing irregular fixation attributable to air bubbles when foam silicone rubber is used to make up the heat-insulating layer 31*b*.

The heat supply roller 33 has the following construction. The heat supply roller 33 has a core 33*a* made of aluminum or a ferrous material, which is in a hollow cylindrical form. The core 33*a* is coated with a heat-resistant releasing layer 33*b* made of a synthetic resin material with good heat-resisting and releasing properties, e.g. an elastic polymer such as silicone rubber or fluorine rubber, or a fluorocarbon resin such as PFA or PTFE. In the present embodiment, a cylindrical shaft made of aluminum with a diameter of 15 mm and a thickness of 0.5 mm is used as the core 33*a*. The heat-resistant releasing layer 33*b* is formed by applying PTFE to a thickness of 20 $\mu$m over the core 31*a* and annealing it.

The heat supply roller 33 has the halogen heater 34 provided therein. In the present embodiment, rated output of the halogen heater 34 is set to 500 W. The heat supply roller 33, provided in an upstream side with respect to the fixing nip region Y in the paper transport path S, is pressed against the upper heat roller 31 with a predetermined pressure.

While the nip width of the heating nip region Z in the present embodiment is about 3 mm, the nip width increases and decreases in accordance with pressing forces of the heat supply roller 33 and the upper heat roller 31. Further, the heat supply roller 33 rotates in accordance with the rotation of the upper heat roller 31 by being pressed against the upper heat roller 31.

The lower heat roller 32 has a core 32*a* on which a heat-resistant releasing layer 32*b* is formed for preventing toner adhesion. The core 32*a* made of aluminum, a ferrous material, or the like is in a hollow cylindrical form. In the present embodiment, a cylindrical shaft made of aluminum with a diameter of 30 mm and a thickness of 1 mm is used as the core 32*a*.

The heat-resistant releasing layer 32*b* is made of a synthetic resin material with good heat-resisting and releasing properties, e.g. an elastic polymer such as silicone rubber or fluorine rubber, or a fluorocarbon resin such as PFA or PTFE. In the present embodiment, the heat-resistant releasing layer 32*b* is formed by applying PTFE to a thickness of 20 $\mu$m over the core 32*a* and annealing it. The lower heat roller 32 has the halogen heater 35 as a heat source provided therein. In the present embodiment, rated output of the halogen heater 35 is 650 W.

Figure 4:
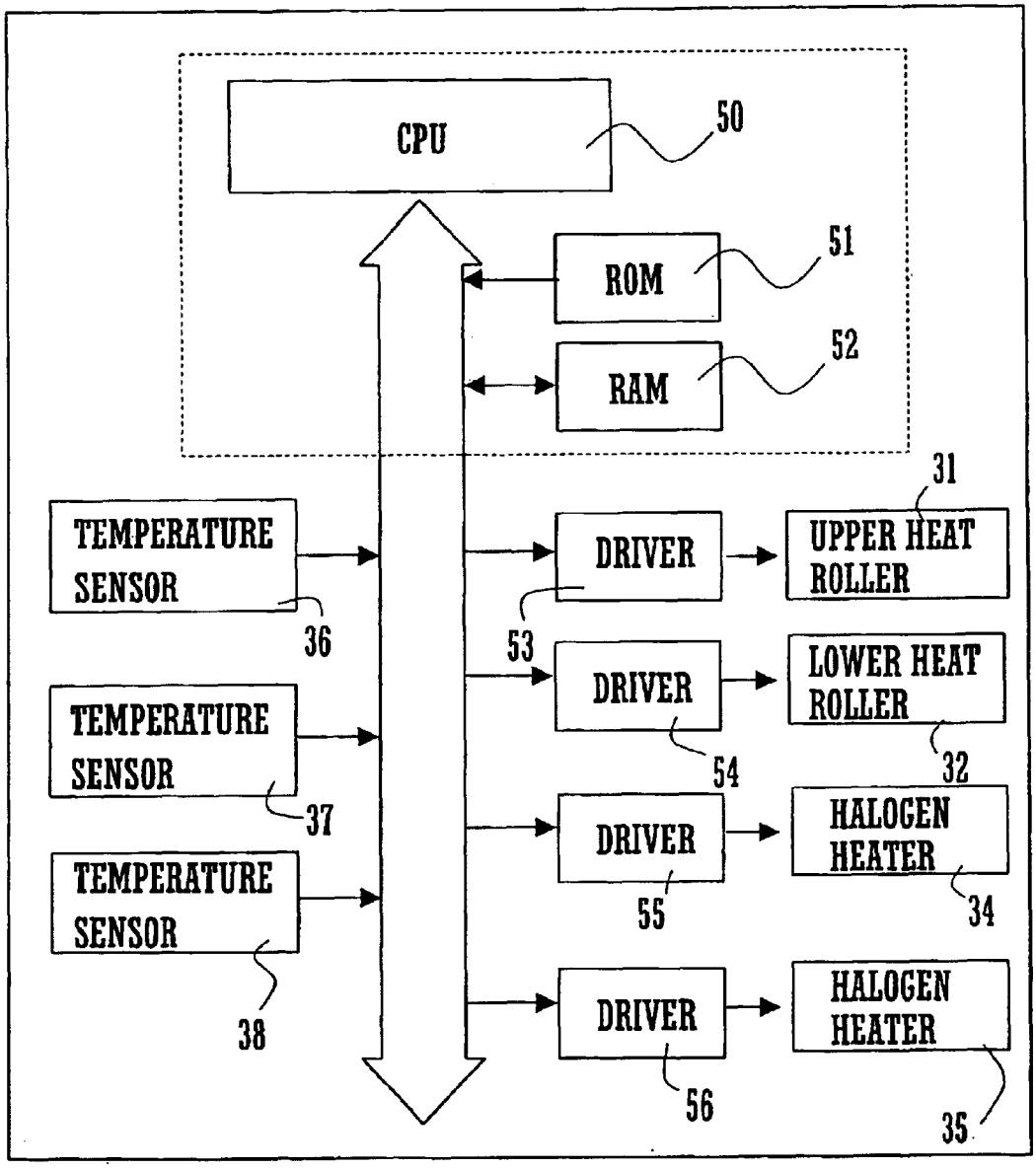
FIG. 4 is a block diagram illustrating the fixing device according to the embodiment of the present invention.

FIG. 4 is a block diagram of the fixing device 30. As illustrated in FIG. 4, in the fixing device 30, CPU 50, ROM 51, RAM 52, the temperature detectors 36 to 38, drivers 53 to 56, the upper heat roller 31, the lower heat roller 32, and the halogen heaters 34 and 35 are electrically connected. Among the foregoing components, the CPU 50, the ROM 51, and the RAM 52 compose the control device of the present invention.

Among the components of the control device, the ROM 51 stores programs required for operation of the fixing device 30. The RAM 52 stores useful information such as the results of experiments on operations of the fixing device 30. The CPU 50 controls operations of the respective components comprehensively.

The control over the operations of the respective components by the CPU 50 differs in four operation modes as described below. Drive control sequences of the fixing device 30 in the respective modes will be hereinafter described with reference to FIGS. 5 to 10.

FIG. 5 illustrates a table of set temperatures of the heat supply roller 33, the upper heat roller 31, and the lower heat roller 32, and ON/OFF states of a drive motor for driving the rollers, in warm-up, copy, standby, and power-saving modes respectively.

First described is the warm-up mode. What is referred to as the warm-up mode in the present invention is a state during a period until the fixing device 30 shifts to normal operation mode after the image forming apparatus 100 is turned on and starts to distribute electric power to the fixing device 30. In the warm-up mode, the CPU 50 turns on the drive motor to drive the heat supply roller 33, the upper heat roller 31, and the lower heat roller 32 to rotate. Simultaneously, the CPU 50 distributes electric power to the halogen heaters 34 and 35 to heat the heat supply roller 33, the upper heat roller 31, and the lower heat roller 32 until each of the rollers reaches a predetermined set temperature. In the present embodiment, the set temperatures of the heat supply roller 33, the upper heat roller 31, and the lower heat roller 32 are 190° C., 130° C., and 150° C. respectively.

Here, while the total input power into the halogen heaters 34 and 35 in the warm-up mode is 1150 W, the CPU 50 sets power to be distributed to the halogen heaters 34 and 35 such that the heat supply roller 33 and the lower heat roller 32 reach the respective set temperatures approximately at the same time.

FIG. 6 illustrates a table of relationhips between power distribution to the halogen heaters 34 and 35, and power consumption and so on. More specifically, FIG. 6 illustrates the result of an experiment on length of a warm-up period and power consumption during the warm-up period under three conditions where power distribution to the halogen heaters 34 and 35 is set differently. FIG. 6 shows that when the heat supply roller 33 and the lower heat roller 32 reach the respective set temperatures approximately at the same time, there is least power wasted during the warm-up period and the length of the warm-up period can be shortened most. While in the case the heat supply roller 33 and the lower heat roller 32 reach the respective set temperatures with a time variance of one second, a time variance of about three seconds is allowable as approximately at the same time in the present invention.

Next described is the copy mode. In the copy mode, the CPU 50 controls power distribution to the halogen heaters 34 and 35 such that the temperatures of the upper heat roller 31 and the lower heat roller 32 are maintained at 130° C. and 150° C. respectively. The CPU 50 also controls power distribution to the halogen heater 34 provided in the heat supply roller 33 such that the temperature of the upper heat roller 31 is maintained at 130° C. In addition, the CPU 50 can control the temperature of the heat supply roller 33 to be maintained at 190° C. such that the temperature of the upper heat roller 31 is maintained at 130° C.

As described above, the fixing device 30 of the present embodiment can eliminate deficiency in heat supply, which is a drawback of an external heating method, by setting the temperature of the lower heat roller 32 heated by the halogen heater 35 provided therein higher than the temperature of the upper heat roller 31 heated by the heat supply roller 33. Therefore, a sufficient amount of heat can be supplied to both of a paper sheet and the upper heat roller 31, even when the external heating method is in use.

Here, optimal temperatures of the upper heat roller 31 and the lower heat roller 32 in copy mode are described with reference to FIG. 7.

FIG. 7 illustrates the results of five experiments on warm-up period length, crease performance (evaluated by criteria samples), transferred heat quantities Q1 and Q2 from the upper heat roller 31 and the lower heat roller 32 respectively to a paper sheet, under five conditions where the temperatures of the upper heat roller 31 and the lower heat roller 32 are set different. In addition, the transferred heat quantities Q1 and Q2 cannot be measured directly, and are thus calculated from a two-dimensional heat transfer simulation.

As illustrated in the experimental result 1 in FIG. 7, when fixing process is performed onto a thick paper sheet if the temperature of the upper heat roller 31 is extremely lower than the temperature of the lower heat roller 32, for example, if the transferred heat quantities Q1 and Q2 satisfy a relationship $(Q2-Q1)/(Q2+Q1) \geqq 0.6$, the thick paper sheet has such a large thermal resistance that heat from the lower heat roller 32 is not sufficiently conducted to a toner layer therethrough. Consequently, there occurs irregular fixing onto the thick paper sheet (128 g/m$^2$ sheet).

Further, if the temperature of the upper roller 31 is too low compared with the temperature of the lower heat roller 32, there occurs curling of a paper sheet or creases on the same. In the fixing process in duplex printing, there also occurs high-temperature offset on a first surface of a paper sheet, on which a toner image is formed and fixed first. The problems as described above tend to occur frequently, particularly when a thin paper sheet is in use.

As illustrated in the experimental result 5 in FIG. 7, on the other hand, if the temperature of the upper heat roller 31 is higher than the temperature of the lower heat roller 32, for example, if the transferred heat quantities Q1 and Q2 satisfy a relationship $(Q2-Q1)/(Q2+Q1) \leqq 0$, there occurs a problem of a longer warm-up period. This is because the higher the temperature of the upper heat roller 31 is set, the greater a proportion of the heat that escapes into the inner heat-insulating layer 31*b* from the surface of the upper heat roller 31 becomes, resulting in lower heating efficiency.

From the above results it follows that the optimal relationship between the transferred heat quantities Q1 and Q2 is $0<(Q2-Q1)/(Q2+Q1)<0.6$.

In addition, even if the temperatures of the upper heat roller 31 and the lower heat roller 32 are set such that the transferred heat quantities Q1 and Q2 satisfy the foregoing relationship, there may still occur irregular fixing in a case of a thick paper sheet with a much heavier basis weight (such as a paper sheet of basis weight 280 g/m$^2$), or a long paper sheet such as an A3 sheet. In the fixing device 30 of the present embodiment, therefore, the CPU 50 utilizes a drive control method for deaccelerating a fixing velocity V (mm/s) by deaccelerating a paper transport speed in proportion to an increase in basis weight of a paper sheet in use or in length of the paper sheet in the paper transport direction.

FIG. 8 illustrates the results of experiments evaluating crease performance and offset occurrence in 14 different patterns of combinations of W, L, and V, where W (g/m$^2$) is basis weight of a paper sheet, L (mm) is length of the paper sheet in the paper transport direction, and Vr (mm/s) is a fixing velocity for a standard paper sheet (with basis weight of Wr (g/m$^2$) and length in the paper transport direction of Lr (mm)). A standard paper sheet in the present embodiment is of basis weight Wr=64 g/m$^2$ and of A4 size (Lr=210 mm), where a standard fixing velocity is Vr=117 mm/s.

Here referred to as the standard paper sheet is a paper sheet which is in standard use in electrophotographic apparatuses, with basis weight Wr of 60 to 80 g/m$^2$ (64 g/m$^2$ in Japanese domestic models; 75 to 80 g/m$^2$ in overseas models) and length in the paper transport direction Lr of: in A4 machines 297 mm (A4R length in the paper transport direction), and in A3 machines 210 mm (A4 length in the paper transport direction).

The image forming apparatus 100 of the present embodiment is a Japanese domestic model in which the maximum paper size available is A3; hence Wr=64 g/m$^2$ and Lr=210 mm.

As illustrated in FIG. 8, if $1.4<(W/Wr)*(L/Lr)*(V/Vr)$, then heat supplied to a paper sheet is insufficient for proper fixing. If $(W/Wr)*(L/Lr)*(V/Vr)<0.6$, on the other hand, then too much heat is supplied to the paper sheet, causing high-temperature offset.

From the experimental results, it follows that proper fixing and offset prevention are compatible when $0.6 \leqq (W/Wr)*(L/Lr)*(V/Vr) \leqq 1.3$. In the present embodiment, the CPU 50 controls to switch between four levels of fixing speed (24/39/56.5/117 (mm/s)) in accordance with basis weight and size of a paper sheet, as shown in the experimental results 6 to 12 in FIG. 8.

FIG. 9 illustrates the result of an experiment conducted to evaluate, in a paper sheet with basis weight of 64 g/m$^2$, crease performance on a second paper surface and high-temperature offset on a first paper surface in duplex printing. In the present embodiment, hereinafter referred to as the first paper surface is a surface on which image forming operation is performed first, and as the second paper surface is a surface reverse to the first paper surface, on which image forming operation is performed after the paper sheet is transported through a switchback transport path.

In the fixing device 30 of the present embodiment, the temperature of the lower heat roller 32 (150° C.) is set higher than the temperature of the upper heat roller 31 (130° C.). Therefore a toner image formed on the first paper surface which gets in contact with the lower heat roller 32 in duplex printing may be fused again, causing high-temperature offset to occur.

Thus, in the present embodiment, the CPU 50 sets the temperature of the lower heat roller 32 lower in duplex printing than in simplex printing, thereby preventing occurrence of high-temperature offset. More specifically, while the paper sheet is being transported toward the fixing device 30 again after fixing operation onto the first paper surface is complete, power distribution to the halogen heater 35 is turned off, such that the temperature of the lower heat roller 32 is lowered from 150° C. to 130° C., and then fixing operation is performed onto the second paper surface.

In the above case, there is concern that crease performance on the second paper surface may decrease. As illustrated in FIG. 9, however, the experimental results prove that the lowering of the temperature of the lower heat roller 32 as described above does not lead to a decrease in crease performance on the second paper surface since the paper sheet is preheated to some degree during fixing operation onto the first paper surface in duplex printing. In addition, the temperature of the lower heat roller 32 is not limited to 130° C., but may be a temperature which is lower than a temperature at which offset occurs and sufficient for proper fixing.

FIG. 10 illustrates the results of experiments on average power consumption, recovery time to copy mode, and life of the respective rollers in three cases where the set temperatures of the respective rollers are set differently in standby mode. When in standby mode, the CPU 50 turns off the drive motor to stop rotation of the respective rollers, as well as setting the temperature of the heat supply roller 33 to 150° C.

A fixing device of internal heating type is usually controlled at the same set temperature in standby mode as in copy mode. If a fixing device of external heating type as of the present embodiment is to be controlled in the same way, as illustrated in a comparative example 1 in FIG. 10, it is necessary to keep respective rollers rotating, with a result that average power consumption becomes higher and roller life, i.e. service life of rollers, becomes shorter because of abrasion and deterioration of surface coating materials of the respective rollers.

Thus, as illustrated in a comparative example 2 in FIG. 10, the CPU 50 stops rotation of respective rollers in standby mode, as well as setting the temperatures of the heat supply roller 33 and the lower heat roller 32 to 190° C. and 150° C. respectively as in copy mode. In the case, average power consumption can be reduced to 111 W and roller life can be also extended.

Although in the above case a period of about five seconds is required for recovery to copy mode, the period is hardly a problem, considering the length of time required for a paper sheet to be transported from the paper feed tray 10 to the fixing device 30, and the like.

Further, the set temperature of the heat supply roller 33 is preferably set lower in standby mode than the temperature in copy mode (190° C.). This is because such a setting can prevent the PFA tube which is used as the surface layer of the upper heat roller 31 from being thermally damaged, and reduce power consumption further. In this case too, a period of about 6.6 seconds required for recovery to copy mode is hardly a problem in practical use.

Lastly, in power-saving mode, the CPU 50 holds the drive motor in OFF state, as well as turning off power distribution to the halogen heaters 34 and 35.

According to the present invention, the following effects can be obtained.

Even when an upper heat roller which is arranged on one side of a paper transport path cannot be supplied with sufficient heat and thereby cannot supply sufficient heat to a paper sheet to be heated, a control device operates a halogen heater which supplies heat to a lower heat roller such that the lower heat roller can be maintained at high temperature. Therefore, even if the upper heat roller does not reach a temperature sufficiently high to supply sufficient heat to the paper sheet, deficiency in heat supply from the upper heat roller can be compensated for and proper heating process can be performed.

In a case where the upper heat roller is heated by a heat supplier arranged outside thereof, the upper heat roller is usually supplied with a less heat by the heat supplier than in a case where the upper heat roller is heated by a heat source provided therein. According to the present invention, the control device controls the halogen heater provided inside the lower heat roller such that sufficient heat is supplied from the halogen heater to the lower heat roller, with a consequence that sufficient heat supply from the lower heat roller to a paper sheet to be heated can be ensured. Thus, deficiency in heat supply from the upper heat roller can be compensated for, and a warm-up period can be reduced without disrupting proper heating process to be performed.

According to the present invention, the surface of the upper heat roller, i.e., a contact region between the upper heat roller and a paper sheet to be heated, can be heated quickly by being made to abut on a heat supply roller as a heat source. Also, since the upper heat roller can be heated uniformly over a circumferential surface thereof while the upper heat roller and the heat supply roller are being driven to rotate, a temperature of the upper heat roller can be detected without difficulty by detecting a temperature of the vicinity of a press region between the rollers instead of a temperature of the press region. Thus, the temperature of the upper heat roller can be controlled conveniently.

According to the present invention, when the lower heat roller is heated to high temperature in order to compensate for deficiency in heat supply from the upper heat roller, heat quantities Q1 and Q2 transferred respectively from the upper and lower heat rollers to a paper sheet are controlled by the control device to satisfy a predetermined relationship therebetween, such that the heat quantity Q2 may not become excessively larger than the heat quantity Q1. Accordingly, it becomes possible to prevent occurrence of reverse curling of, or crease on, the paper sheet due to excessive heating of only one surface of the paper sheet. Further, it is possible to prevent heating efficiency to a thick paper sheet from being decreased. Furthermore, it becomes possible, for example, to prevent high-temperature offset from occurring on one surface of a paper sheet when the other surface is printed in duplex printing in the image forming apparatus.

According to the present invention, the control device controls power distribution to the heat supply roller and the lower heat roller, such that a time lag which occurs when the heat supply roller and the lower heat roller reach respective set temperatures thereof may be limited, for example, within two seconds. Therefore it becomes possible to reduce waste in power consumption during a period between the time that the heating device is powered on and the time that proper temperature control is enabled after completion of warm-up, as well as to reduce time required before the completion of warm-up.

According to the present invention, the control device adjusts paper transport speed in the heating device in accordance with factors such as basis weight or length in a transport direction of a paper sheet, which have effects on efficient heat supply to the paper sheet from the lower heat roller and uniform heating process over the whole paper sheet. Accordingly, it becomes possible to eliminate disadvantages such as that a thick paper sheet is not effectively supplied with heat by the lower heat roller, or that deficiency in heat supply from the heat supply roller causes an excessive decrease in heat supply to a foot portion of a paper sheet which is long in a paper transport direction.

When the heating device of the present invention is used as a fixing device of an image forming apparatus equipped with a duplex printing function, temperature of the lower heat roller, which contacts with a first surface of a paper sheet with a developer image already fixed thereon when a second surface of the paper sheet is printed, is set lower than an offset temperature at which the fixed developer image fuses. This arrangement ensures prevention of offset. In duplex printing, further, since the paper sheet is sufficiently heated in the process of fixing onto the first surface thereof and thus preheated to a certain degree, a decrease in crease performance can be prevented by setting the temperature of the lower heat roller low.

According to the present invention, in the heating device in standby mode, only the lower heat roller, which has a heat source therein and therefore need not be driven to rotate for being kept warm, is held at the same temperature as in normal operation mode, while power supply to a drive system in the upper and lower heat rollers is turned off. The lower heat roller is already at a predetermined set temperature when the heating device recovers from a standby state to a normal operational state, and therefore recovery time can be shortened. In standby mode, moreover, power is not supplied to a drive system in the upper and lower heat rollers, with a consequence that power consumption can be reduced and thermal deterioration or abrasion of the upper and lower heat rollers can be prevented.

As described so far, according to the present invention it is possible to provide a heating device and heating method enabling a shortened warm-up time, reduced power consumption in standby mode, and high efficiency in heat supply to heating members.

What is claimed is:

1. A heating method comprising:

providing (i) first and second heating members arranged with a sheet material transport path therebetween in such a manner as to be pressed against each other at a contact region of said transport path;

(ii) a first heat supplier for supplying heat to the first heating member;

(iii) a second heat supplier for supplying heat to the second heating member;

(iv) detectors for detecting temperatures of the first and second heating members; and (v) a control device for controlling the operation of the first and second heat suppliers in accordance with detection results by the detectors;

transporting a sheet material through said contact region between said first and second heating members; and supplying heat to the second heating member from the second heat supplier such that a heat quantity Q2 transferred from the second heating member to said sheet material is higher than a heat quantity Q1 transferred by the first heating member to said sheet material and the heat quantities Q1 and Q2 satisfy the following relationship:

$$0<(Q2-Q1)/(Q2+Q1)<0.6.$$

2. A heating method comprising: providing (i) first and second heating members arranged with a sheet material transport path therebetween in such a manner as to be pressed against each other at a contact region of said transport path;

(ii) a first heat supplier for supplying heat to the first heating member;

(iii) a second heat supplier for supplying heat to the second heating member;

(iv) detectors for detecting temperatures of the first and second heating members; and (v) a control device for controlling the operation of the first and second heat suppliers in accordance with detection results by the detectors; and supplying power to said first and second heating members such that (i) the temperature of the second heating member is higher than the temperature of the first heating member, (ii) the temperatures of the first heating member and the second heating member reach respective preselected set temperatures at approximately the same time after the initiation of the supply of power, and (iii) a heat quantity Q2 transferred from the second heating member to said sheet material is higher than a heat quantity Q1 transferred by the first heating member to said sheet material and the heat Quantities Q1 and Q2 satisfy the following relationship:

$$0<(Q2-Q1)/(Q2+Q1)<0.6.$$

3. A heating method comprising:

(i) providing an image forming unit having first and second heating members arranged with a sheet material transport path therebetween in such a manner as to be pressed against each other at a contact region of said transport path;

(ii) a first heat supplier for supplying heat to the first heating member;

(iii) a second heat supplier for supplying heat to the second heating member;

(iv) detectors for detecting temperatures of the first and second heating members; and (v) a control device for controlling the operation of the first and second heat suppliers in accordance with detection results by the detectors; setting the temperature of the second heating member higher than the temperature of the first heating member such that when duplex printing is performed in the image forming unit the temperature of the second heating member is lower than a minimum temperature at which offset occurs, providing a sheet material having a pre-fixed developer image thereon, the pre-fixed developer image having been transferred to said sheet material from an image carrier in an electrophotographic image forming unit, transporting said sheet material along said transport path and through said contact region such that said first and second heating members press and heat said sheet material, and supplying heat to the second heating member from the second heat supplier such that a heat Quantity Q2 transferred from the second heating member to said sheet material is higher than a heat quantity Q1 transferred by the first heating member to said sheet material and the heat quantities Q1 and Q2 satisfy the following relationship:

$$0<(Q2-Q1)/(Q2+Q1)<0.6.$$

* * * * *